US006311836B1

(12) United States Patent
Maeng

(10) Patent No.: US 6,311,836 B1
(45) Date of Patent: Nov. 6, 2001

(54) GOLF BAG WITH STAND

(76) Inventor: Seop Maeng, 903-7 Gorim-Ri Yongin-Eup, Yonging-Kun Kyungkido, Seoul (KR)

( * ) Notice: Subject to any disclaimer, the term of this patent is extended or adjusted under 35 U.S.C. 154(b) by 0 days.

(21) Appl. No.: 09/238,825

(22) Filed: Jan. 28, 1999

(30) Foreign Application Priority Data

Jan. 30, 1998 (KR) ..... 98-973

(51) Int. Cl.[7] ..... A63B 55/00
(52) U.S. Cl. ..... 206/315.7; 248/96; 248/166
(58) Field of Search ..... 248/96, 166; 206/315.7

(56) References Cited

U.S. PATENT DOCUMENTS 4,798,357 * 1/1989 Cho ..... 206/315.7 X
5,147,089 * 9/1992 Anderson ..... 206/315.7
5,507,384 * 4/1996 Maeng ..... 206/315.7
5,678,791 * 10/1997 Maeng ..... 206/315.7 X
5,762,189 * 6/1998 Reimers ..... 206/315.7
5,799,786 * 9/1998 Beck et al. ..... 206/315.7
5,816,399 * 10/1998 Rhee ..... 206/315.7
5,857,567 * 1/1999 Cheng ..... 206/315.7
6,010,101 * 1/2000 Stein et al. ..... 206/315.7 X

* cited by examiner

*Primary Examiner*—Allan N. Shoap
*Assistant Examiner*—Tri M. Mai
(74) *Attorney, Agent, or Firm*—Chapman and Cutler

(57) ABSTRACT

A golf bag has a stand that effectively reduces the gap between a bag body and its actuating lever. Two legs are hinged to a bracket on the bag body at their top ends, while an actuating lever, used for selectively opening the two legs, is hinged to the two legs at the top end and is kept in substantial contact with the bag body while being operated. The lever has a longitudinal stem section with two diverging arms at the top end of the lever and a holding loop at the lower end. The two arms diagonally pass behind the two legs and are fitted into hinge holes on the legs from the outside to the inside. A base at the bottom of the bag body has a vertical cutout for the lever holder of the actuating lever, thus allowing the actuating lever to be kept in substantial contact with the bag body during its operation.

18 Claims, 6 Drawing Sheets

GOLF BAG WITH STAND

FIELD OF THE INVENTION

The present invention relates to golf bags with stands. More particularly, it relates to a golf carry bag with a stand having a reduced gap between the bag body and the actuating lever.

BACKGROUND OF THE INVENTION

In typical golf carry bags with stands, an actuating lever for the legs of the stand is spaced apart from the sidewall of the bag body, protruding beyond the stand legs from the sidewall. Due to such construction, the typical golf bag often cannot be stably held on a golf cart. The conventional actuating lever also enlarges the volume of the golf bag and stand structure. Consequently, it is more difficult for a golfer to carry the bag. Another problem of such typical golf bag stand structures is that dirt may easily become lodged between the actuating lever and the bag body and/or the stand legs, thus preventing the actuating lever from operating smoothly.

SUMMARY OF THE INVENTION

One object of the invention is to provide a golf bag with a stand that effectively reduces the gap between the bag body and the actuating lever for the stand. This reduces the volume of the golf bag and reduces lodging of dirt in the gap so as to allow the lever to be smoothly operated. The present invention has a simple construction, thereby reducing the production cost of the golf bag. It also allows the golf bag to be stably held on a golf cart during use on a golf course.

This invention has several features, no single one of which is solely responsible for its desirable attributes. Without limiting the scope of this invention as expressed by the claims that follow, its more prominent features will now be discussed briefly. Features of this invention include lower total volume, elimination or reduction of the gap between the bag body and actuating lever, and ease of control of the tension applied to causing the legs to retract.

A first feature of the golf bag and stand of this invention is a bag body having an upper portion, a bottom, and a side. A pair of legs, each leg each having a top end with a hinge hole therein, are hinged at the top ends to the upper portion of the bag body. The legs are moved manually between retracted and extended positions by an actuating lever upon tilting of the bag while its bottom rests on a support surface.

A second feature is the actuating lever that controls the operation of the legs. This lever has a pair of upper ends and a lower end. Each upper end is hinged to the hinge holes in the legs. In a preferred embodiment of this invention, the actuating lever includes a U-shaped spring with its center section encased in a tensioning member and its upper ends having a pair of diverging upper arms. The upper arms terminate in terminal ends, each being inserted into one of the hinge holes. Each diverging arm diagonally passes behind one of the top ends of each leg and is fitted into the hinge holes of the legs from the outside to the inside.

A third feature is that the U-shaped spring of the actuating lever is made of wire. It is formed by bending a wire into a U-shaped configuration, with opposite ends of the wire forming the diverging arms and a bent portion forming a holding loop at a lower end. The central section forms an intermediate stem portion between the two arms and the holding loop, encased in a sleeve, tube, or rings to tension the spring part. The tube, etc., may be fixed or moveable along the central section. If moveable, the tube, etc., may be moved manually in opposite directions to control selectively the tension on the legs. In one embodiment, the longitudinally moveable member is a binding ring, and in another it is a tubular member. Preferably, in the one embodiment, there are a plurality of the binding rings, the uppermost one being longitudinally movable along the center section of the U-shaped spring in opposite directions, thus selectively controlling the tension on the legs.

A fourth feature is that a base at the bottom of the bag body has a vertical cutout section that cooperates with the lower end of the actuating lever through a loop holding lever that moves within the cutout section. This cutout enables a substantial portion of the actuating lever to be kept in contact with, or close to, the side of the bag body for operation of the lever. The cutout section of the base has a height of larger dimension than its depth, and the depth ranges preferably from about 0.17 to about 0.25 times a major axis (or length) of the base, and the height ranges from about 1.1 to about 1.5 times the depth of the cutout.

A fifth feature is that, in one embodiment, the actuating lever passes into the bag body through an insert hole in the side of the bag body, passing through the bag body and, through a guide hole in the base, into the cutout section of the base. The guide hole is formed in the base, thus maintaining the position of the actuating lever relative to the bag body. When passing into and through the bag body, the stem portion is in contact with, or close to. the inside surface of the side of the bag.

THE DRAWINGS

DETAILED DESCRIPTION OF THE PREFERRED EMBODIMENTS

Figure 5:
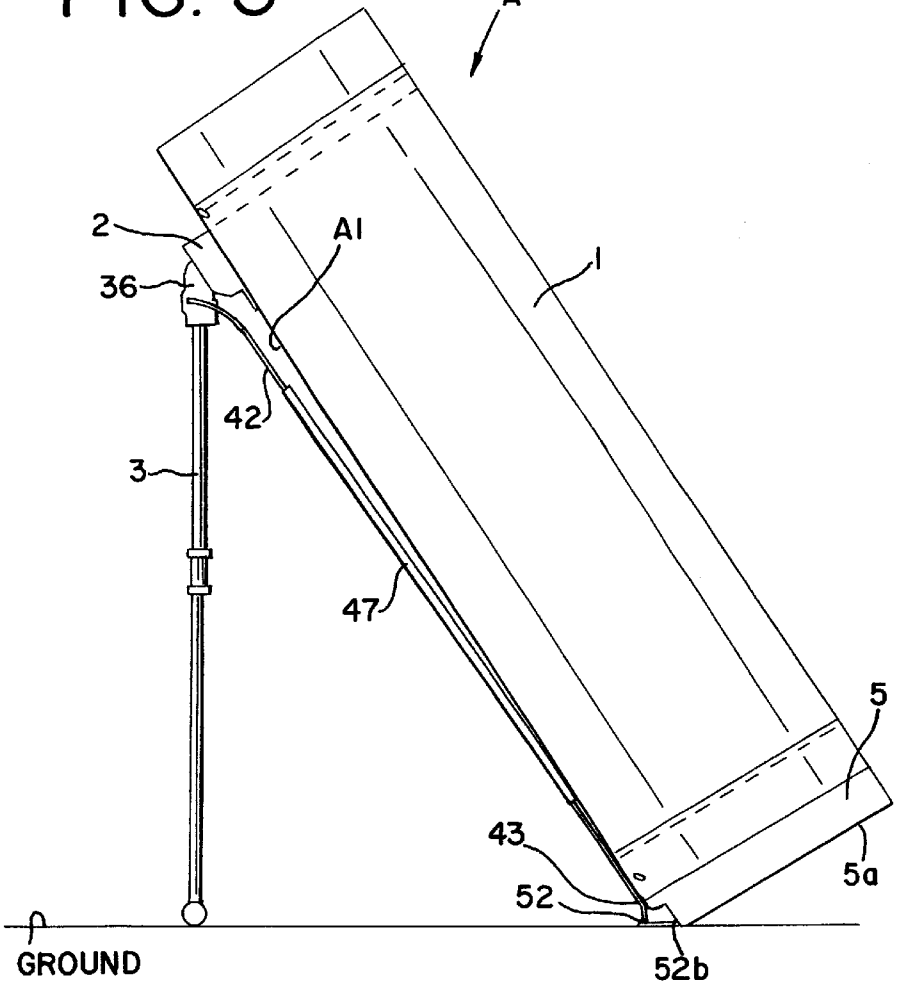
FIG. 5 is a side view taken with the golf bag and stand leaning to one side and the legs of the stand extended.
Figure 6:
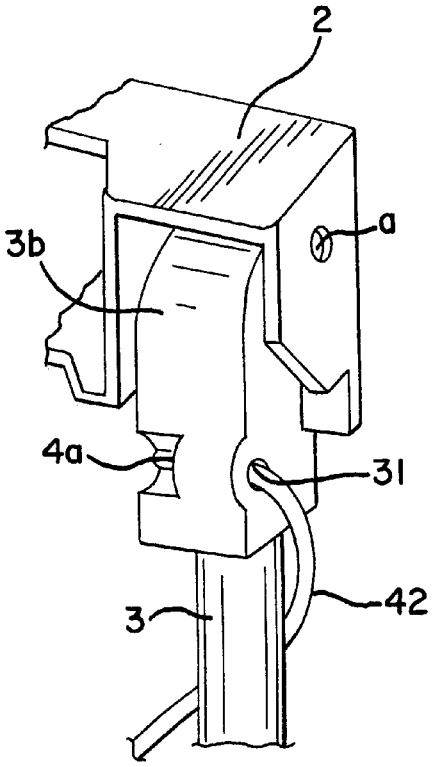
FIG. 6 is an enlarged, fragmentary, perspective view of the encircled portion "B" of the golf bag and stand of FIG. 1.

FIGS. 1 to 7 show a golf bag A provided with a stand in accordance with the first embodiment of the invention. Golf bag A comprises a bag body 1 with a bracket 2 mounted to its upper portion. A pair of legs 3 are hinged at their top ends 3*b* to the bracket 2, as in FIG. 4. As best shown in FIG. 6, a hinge hole 31 extends through each leg 3 near its top end 3*b*. An actuating lever 4, which selectively opens or spreads the two legs 3 so as to allow the golf bag A to stand on a support surface such as the ground, is mounted to the hinge holes 31 of the legs 3. The actuating lever 4 is kept in contact with, or close to, the side A1 of the bag body 1 during its operation. The actuating lever 4 includes a wire with a pair of ends 4*a*, each being individually inserted into one of the hinge holes 31.

The golf bag A also has a base 5 at the bottom of the bag body 1. A front surface of the base 5 has a vertical cutout 51 (FIG. 4) that holds a lower end 4*b* of the actuating lever 4 in a manner that keeps substantially the entire lever 4 in contact with, or close to, the side A1 of the bag body 1 throughout its operation.

The actuating lever 4 includes a tensioning member formed with a longitudinal stem section 41 comprising. for instance, a tube. The tube encases a U-shaped bent wire 42*a*. The wire 42*a* has having two diverging arms 42 at the top end of the lever and extending upward from the stem section. The wire 42 also has a holding loop 43 extending from the lower end of the stem section. In this embodiment, the upper end of the tube forming the stem section 41 is crimped onto the wire 42 so that the stem section is in a fixed, immovable position.

The holding loop 43 at the lower end of wire 42 is positioned in or near the cutout 51 of the base 5.

Figure 1:
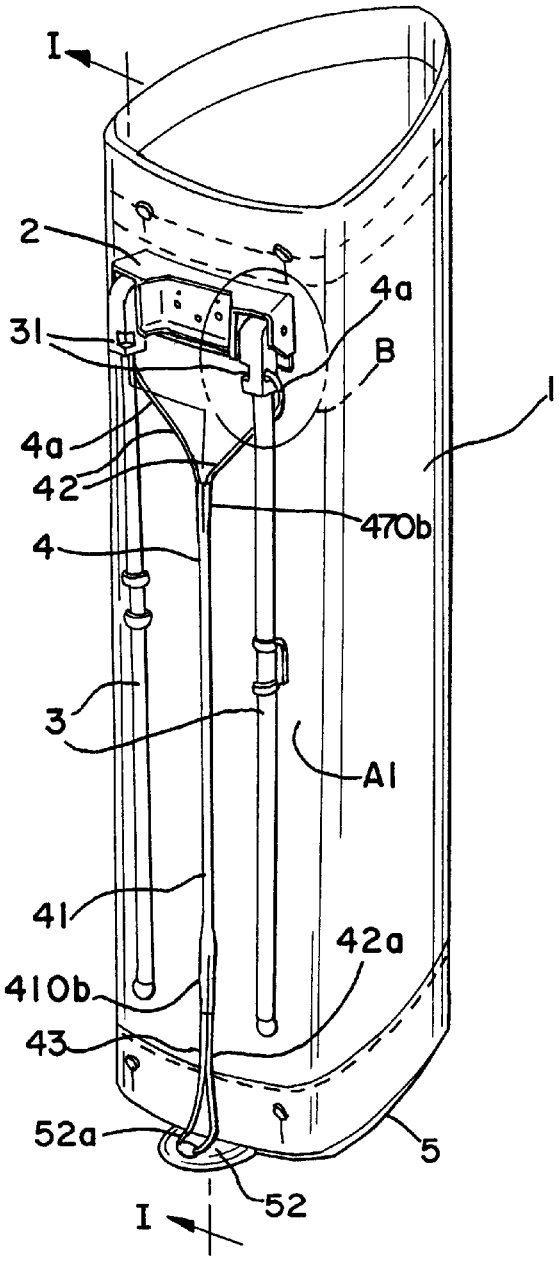
FIG. 1 is a perspective view of a golf bag provided with a stand in accordance with a first embodiment of the invention.
Figure 2:
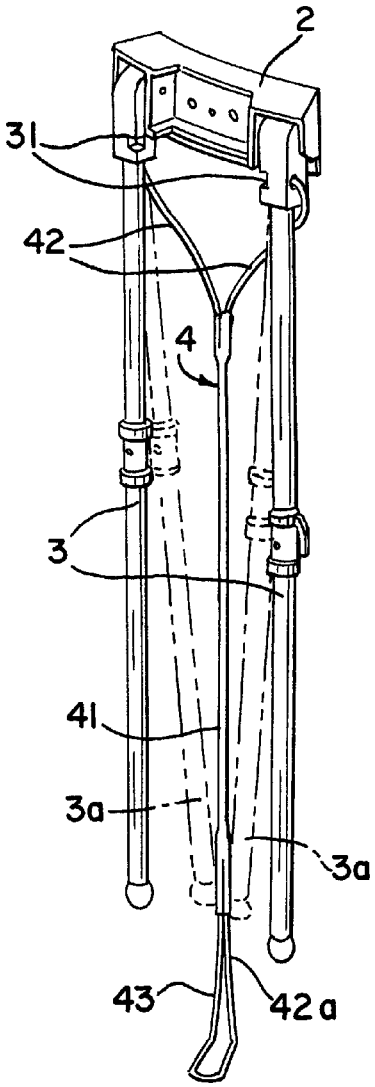
FIG. 2 is a perspective view of the stand used with the golf bag of FIG. 1.
Figure 3:
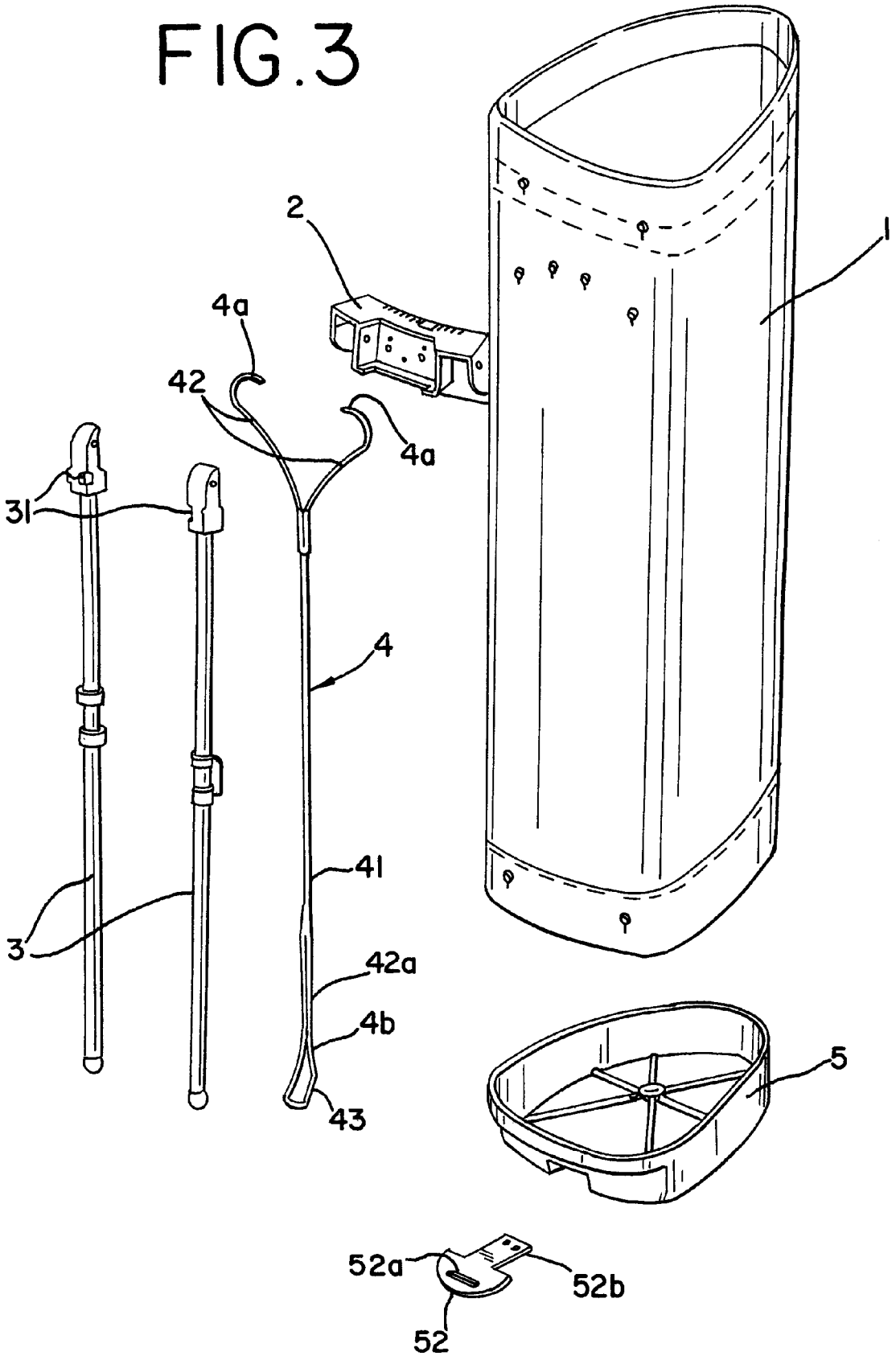
FIG. 3 is an exploded perspective view of the golf bag and stand of FIG. 1.

The two upper arms 42 of the lever 4 are bent inwardly at the top ends 4*a*, and these ends are fitted into the hinge holes 31 of the legs 3 from the outside to the inside, respectively, as best shown in FIGS. 1 and 5. As in FIG. 5, the two arms 42 each diagonally pass behind one of the two legs 3 prior to being elastically fitted into the hinge holes 31 from the outside to the inside. The stem section 41 of the lever 4 is thus positioned under the legs 3 so the lever 4 is elastically kept in contact with, or close to, the bag body 1.

In order to mount the lever 4 to the hinge holes 31, the two arms 42, which are resilient, are spread open by pulling them apart prior to fitting them into the hinge holes 31. Therefore, when the two arms 42 are completely set in the hinge holes 31, the two arms 42 elastically push the legs 3 toward the bag body 1 so that these legs contact, or are close to, the side A1 of the bag body. This arrangement reduces the gap between the lower portions 3*a* of the legs 3. In fact, the lower portions 3*a* of the legs 3 may overlap or contact, as shown in the dotted lines in FIG. 2. Thus, in the retracted position, the legs 3 are urged against, or very close to, the side A1 of the bag body, so that the lower portions 3*a* of the legs 3 are near to each other or even overlapping.

As described above, the actuating lever 4 according to the first embodiment comprises four parts: the stem section 41, two arms 42, and the holding loop 43. However, the construction of the lever 4 may be varied without affecting the functioning of this invention. For example, the lever 4 may advantageously be formed by bending a wire into a U-shaped configuration, with the opposite ends of the wire forming the two arms 42 and the bent portion forming the lower holding loop 43. Then the intermediate portion between the two arms 42 and the holding loop 43 is bound together with a moveable binding means such as a tube or rings, as will be described below.

The base 5 is mounted to the bottom of the bag body 1 and has a vertical cutout 51 at the front lower surface. Provided in the cutout 51 is a lever holder 52, which engages with the holding loop 43 of the lever 4. The holding loop 43 of the actuating lever 4 passes through a channel 52*a* which allows the holding loop 43 to pivot when the lever holder 52 is pressed against the ground and the lever holder 52 pivots, as shown in FIG. 5, as the legs 3 are moved to their extended position.

Figure 4:
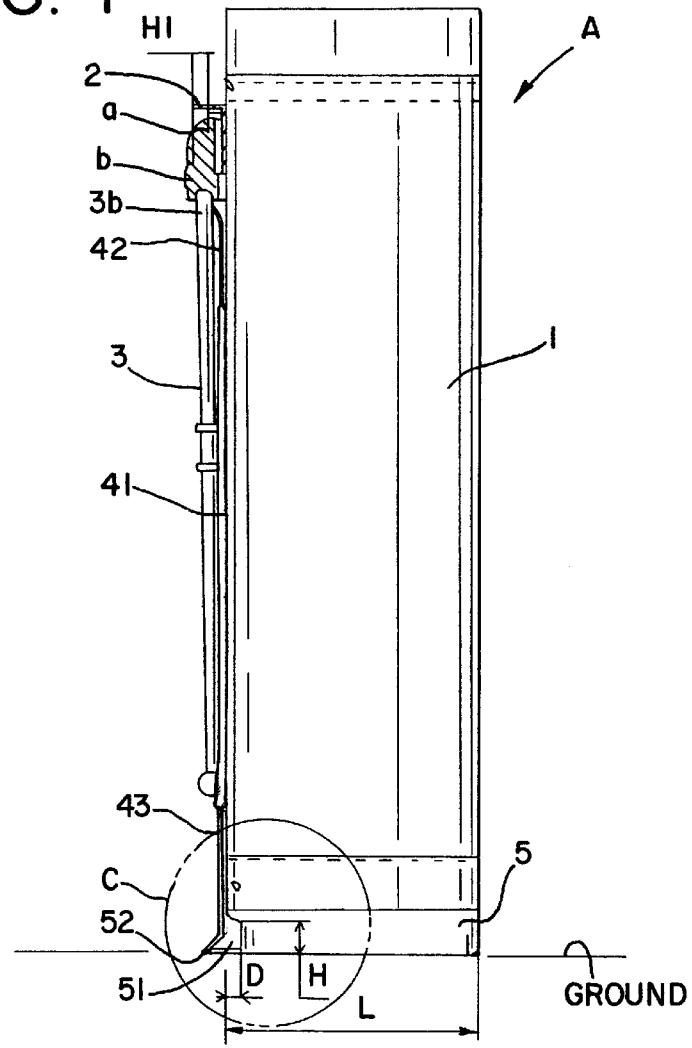
FIG. 4 is a side view, partly in section, of the golf bag and stand, taken along line I—I of FIG. 1.

In the golf bag A of this invention, the actuating lever 4 is kept in contact with, or close to, the side A1 of the bag body 1 while being operated. The cutout 51 in the base 5 permits this. As illustrated in FIG. 4, in order to allow the actuating lever 4 to operate smoothly, the depth "D" of the cutout 51 is preferably less than the height "H" of the cutout 51. If the base 5 did not have such a cutout 51, the lever 4 could not be raised with the holding loop 43 of the lever 4 being kept in contact with, or close to, the bag body 1 as the golf bag A is leaned to one side while resting on the support surface.

In the golf bag A of this invention, it is preferable to allow the lever holder 52 to be inclined upwardly at an angle of inclination of up to about 45° when the golf bag is leaned to one side while supported on the support surface, as in FIG. 5. This is accomplished by making the maximum depth D of the cutout 51 less than the height H. The ratio of the height H to the depth D of the cutout 51 is related to the gap H1 (FIG. 4) between the hinged axis a of the legs 3 and the hinged axis b of the lever 4. In the present invention, the ratio of the height H to the depth D is preferably set within about 1–1.5.

The operation of the golf bag A is as follows.

In a normal vertical position of the golf bag A as shown in FIG. 4, substantially the entire structure of the actuating lever 4 is in contact with, or close to, the side A1 of the bag body 1, and the end of the loop holder 52 is nearly even with the bottom surface of the base 5. In FIG. 4, the legs 3 are in a retracted position. As shown in FIG. 5, when the golf bag A is leaned to one side, lifting the one end 5*a* of the base off the ground at an angle of inclination of up to about 45°, the loop holder 52 is pushed upwardly by its contact with the ground, thus lifting the actuating lever 4 within the height "H" of the cutout 51 and opening the legs 3. During such an ascending motion of the lever 4 for opening the legs 3, the arms 42 move a slight distance away from the side A1 of the bag body 1, but the stem 41 of the lever 4 is not spaced apart by any significant amount from the side A1 of the bag body 1. Rather the stem 41 is kept substantially in contact with, or close to, the side A1 of the bag body 1 due to the cutout 51 of the base 5. The lever holder 52 is flexible and resilient and bends in a hinge-like manner at its back portion 52*b* as depicted in FIG. 5. Upon returning the golf bag A to the vertical orientation shown in FIG. 4 by standing the bag on the bottom of the base 5 to rest the base flat against the ground, the two arms 42 of the actuating lever 4 elastically bias the legs 3 to close them automatically. The stem 41 of the lever 4 descends to its original position shown in FIG. 4, riding along the surface of the side A1, and the arms 42 return to a position either contacting the side A1 or positioned closely to the side A1. The lever holder 52, bending about the back portion 52*b*, returns to the position shown in FIG. 4.

When the cutout 51 is exceedingly deep as in the prior art, with a depth of ⅓ to ½ of the major axis L of the base 5, the golf bag A cannot stably stand on the support surface and may tip over and fall. Such an exceedingly deep cutout also causes the gap between the lower portion 3*a* of the legs 3 to be unexpectedly widened. In the prior art, a golf bag with a half tapered bottom has been proposed and used. However, in such a golf bag, the depth D is two or three times greater than the height H. Consequently, such a prior art the golf bag cannot stably stand on the support surface. Such a tapered bottom also causes golf clubs to lean to one side in the golf bag, thus entangling the golf clubs, which is inconvenient for the user. In this regard, it is preferable to set the depth D of the cutout 51 to about ¼–1/6 of the major axis L of the base 5.

Figure 8:
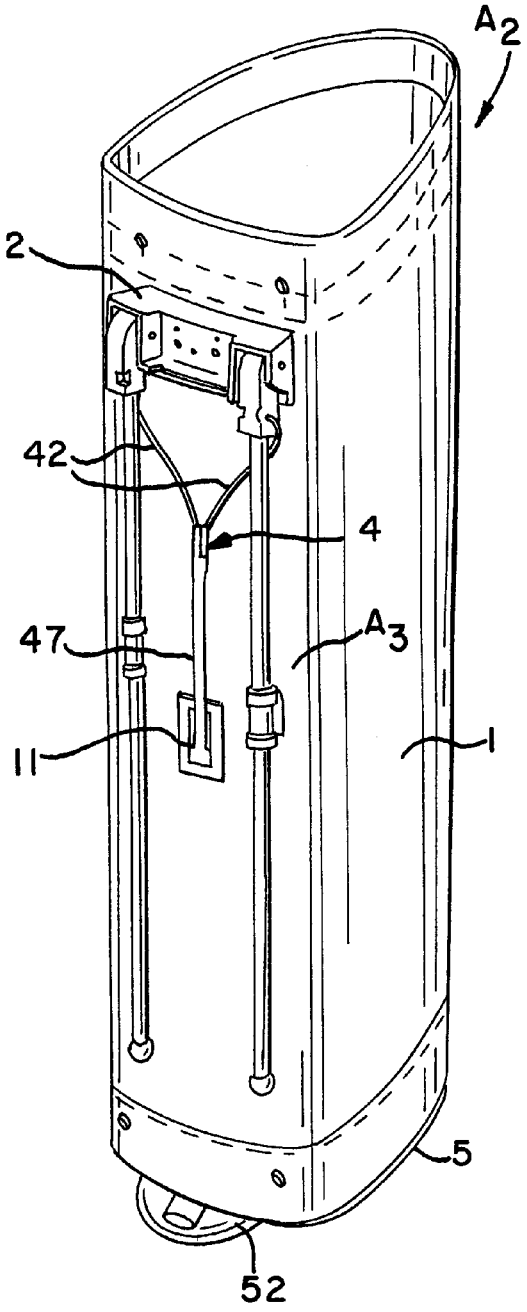
FIG. 8 is a perspective view of a golf bag provided with a stand in accordance with a second embodiment of the invention.
Figure 7:
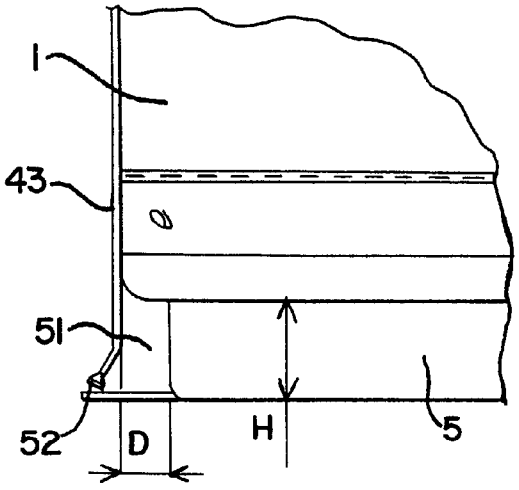
FIG. 7 is an enlarged, fragmentary, sectional view of the encircled portion "C" of the golf bag and stand of FIG. 4.
Figure 9:
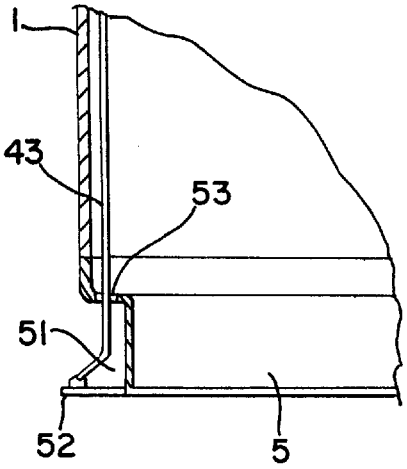
FIG. 9 is a sectional view of the base of the golf bag and stand combination of FIG. 8.

FIGS. 8 and 9 are views of a golf bag A2 provided with a stand in accordance with the second embodiment of this invention. In this second embodiment, the stem section 41 of the actuating lever 4 is inserted into the bag body 1 through an insert hole 11 in the side A3. The stem section 41 passes through the lower portion of the bag body along the inside surface of the side A3 prior to projecting through a guide hole 53 (FIG. 9) into the cutout 51 of the base 5. Therefore, the major part of the stein section 41 of the actuating lever 4 is covered within the bag body 1 and is in contact with, or close to, the inside surface of the side A3 of the bag A2. This provides protection against unexpected impact and against collecting dirt. Although it is preferred to attach the holding loop 43 to the lever holder 52, in this second embodiment it may not be necessary, since the lever 4 is held by both the insert hole 11 and the guide hole 53. This arrangement effectively keeps the lever 4 in position without being attached by the lever holder 52.

Figure 10:
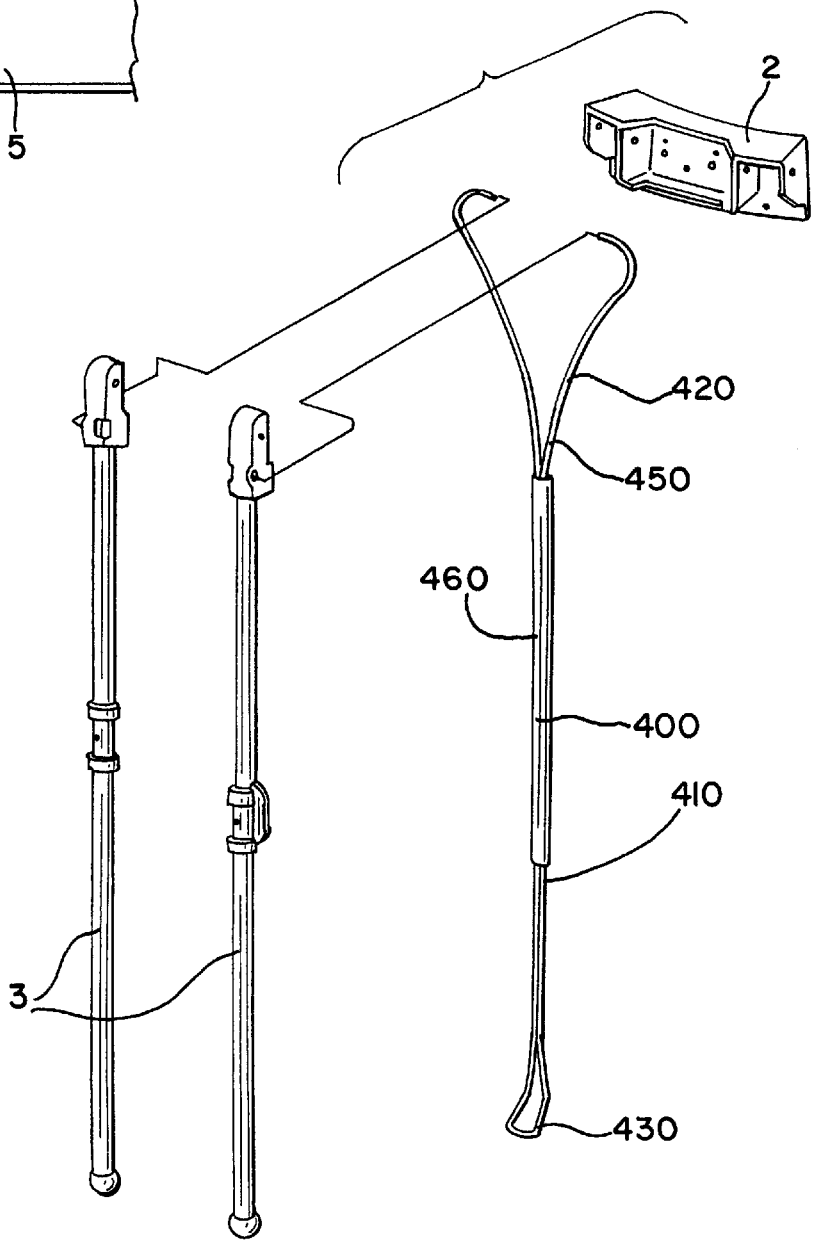
FIG. 10 is an exploded perspective view of a golf bag and stand in accordance with a third embodiment of the invention.
Figure 11:
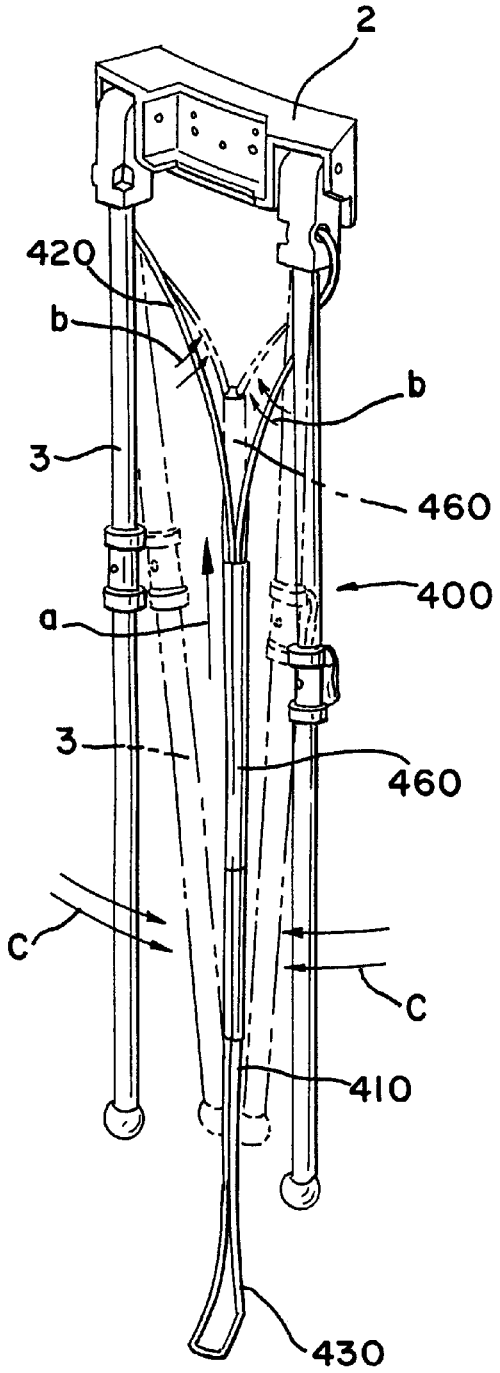
FIG. 11 is a perspective view showing the operation of the stand of FIG. 10 and indicating variation of the tension on the stand legs.

FIGS. 10 and 11 are views of a golf bag stand in accordance with the third embodiment of the present invention. In this third embodiment, an actuating lever 400, similar to the lever 4, comprises a wire 450 which is formed by bending same into a form with upper diverging arms 420, an intermediate stem section 460 comprising a tube or the like encasing the center portion 410 of the bent wire, and a lower holding loop 430. The stem section tube 460 is slideable over the center portion 410 of the bent wire to different positions to vary the tension applied by the U-shaped spring wire. Selective positioning of this stem section tube 460 thus controls the tension of the two legs 3.

The actuating lever 400 of this embodiment is formed by bending a wire into a U-shaped configuration, with the opposite ends of the wire forming the diverging arms 420 and the lower bent portion forming the holding loop 430. The stem section 460 may be in the form of a hollow pipe that is movably over the center portion 410 of the bent wire between the two arms 420 and the holding loop 430. Consequently, the stem section 460 is slideable along the center portion 410 in opposite directions so as to selectively control or vary the tension applied to the legs 3. That is, when the stem section 460 is lifted in the direction shown by arrow a of FIG. 11 from the lower position (shown by the solid line) to the upper position (shown by the phantom line), the two arms 420 of the actuating lever are biased to the inside as shown by arrow b. This biases the two legs 3 in a direction as shown by arrow c. Therefore, the two legs 3, tensioned and positioned as shown by the phantom line, are elastically opened and closed, thus being convenient in operation to a user. The golf bag stand according to this third embodiment selectively controls the tension of the legs 3 by longitudinally moving the stem section 460 in opposite directions relative to both the diverging arms 420 and the holding loop 430.

Figure 12:
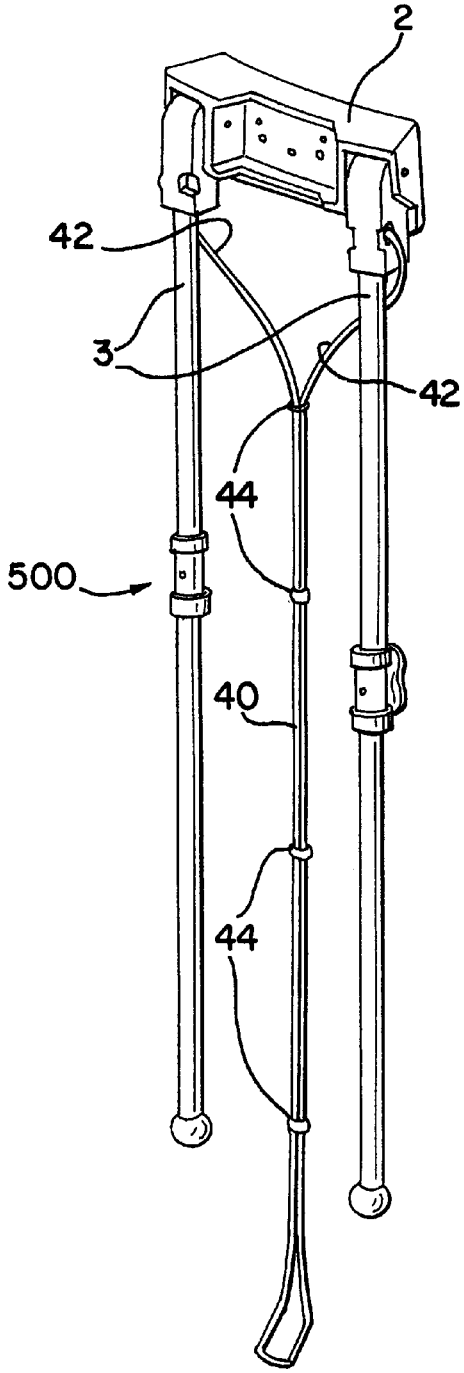
FIG. 12 is a perspective view of a golf bag stand in accordance with a fourth embodiment of the invention.

FIG. 12 shows the fourth embodiment of the invention, with an actuating lever 500. In this fourth embodiment, in order to form the actuating lever 500, a wire is bent into a U-shaped configuration with the opposite ends of the wire forming the two diverging arms 42 and the bent portion forming the holding loop 43 in the same manner as that described for the third embodiment. However, the intermediate portion between the two arms and the holding loop are bound by a plurality of binding rings 44, with the uppermost ring 44 being movable along the intermediate portion in opposite directions. The golf bag stand of this embodiment thus selectively controls or varies the tension of the legs 3 by longitudinally moving the uppermost ring 44 along the intermediate portion in opposite directions.

As described above, the present invention provides a golf bag with a stand effectively reducing the gap between the bag body and the actuating lever. The stand thus reduces the volume of the golf bag, prevents the lodging of dirt in the gap so as to allow the lever to be smoothly operated, has a simple construction, reduces the production cost of the golf bag, and allows the golf bag to be stably held on a golf cart during golfing.

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which arc fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A golf bag comprising a bag body having an upper portion, a bottom, and a side;

a pair of legs, each leg having a top end with a hinge hole therein and being hinged at said top ends to the upper portion of the bag body;

an actuating lever for selectively moving the legs between retracted and extended positions, said lever comprising a U-shaped wire enclosed along a major part of its length in a tube, the wire forming a pair of upper ends and a lower end, each upper end being hinged to said hinge holes; and a base at the bottom of the bag body having a cutout section which holds the lower end of the wire of the actuating lever, thereby enabling the portion of the lever comprising the tube to be kept in close proximity to the side of the bag body during operation of the lever.

2. The golf bag of claim 1 where the actuating lever is inserted into the bag body through an insert hole in the side of the bag body, passing through the bag body to project into the cutout section of the base through a guide hole in the base.

3. The golf bag of claim 2 where said guide hole is formed in the base, thus maintaining the position of said lever relative to the bag body.

4. The golf bag of claim 1 where said cutout section of the base has a height of larger dimension than its depth, with said depth reaching 16% to 25% of a major axis of the base and said height reaching 110% to 150% of said depth.

5. The golf bag of claim 1 where said actuating lever has two diverging arms forming said upper ends, said diverging arms diagonally passing behind the top ends of each leg and being fitted into the hinge holes of the legs from the outside to the inside.

6. The golf bag of claim 5 where the actuating lever includes a longitudinal stem section, a holding loop at a lower end of said stem section, and the two diverging arms at a top end of the stem section.

7. The golf bag of claim 5 where said actuating lever is formed by bending a wire into a U-shaped configuration, with opposite ends of said wire forming the two diverging arms and a lower bent portion forming a holding loop positioned in the cutout of the base, and a center portion between the two arms and the holding loop, said center portion being covered with a longitudinally moveable tensioning member.

8. The golf bag of claim 7 where said moveable member is moved manually in opposite directions, thus selectively controlling the tension of the two legs.

9. A golf bag comprising a bag body having an upper portion, a bottom, and a side;

a pair of legs, each leg having a top end with a hinge hole therein and being hinged at said top ends to the upper portion of the bag body;

a unitary, unjointed actuating lever for selectively moving the legs between retracted and extended positions, said lever having a lower end comprised of flexible wire construction, a pair of upper, diverging arms also of wire construction, and tube covering a major portion of the lever, said upper arms terminating in terminal ends with each terminal end being inserted into one of said hinge holes; and a base at the bottom of the bag body having a cutout section which holds the lower end of the unitary actuating lever, thereby enabling a substantial portion of the lever to be kept in close proximity to the side of the bag body during operation of the lever.

10. The golf bag of claim 9 where said upper arms diagonally pass behind the top ends of each legs and being fitted into the hinge holes of the legs from the outside to the inside.

11. The golf bag of claim 9 wherein said tube is longitudinally moveable.

12. The golf bag of claim 9 where the actuating lever is inserted into the bag body through an insert hole in the side of the bag body, passing through the bag body to project into the cutout section of the base through a guide hole in the base.

13. The golf bag of claim 9 where said cutout section of the base has a height of larger dimension than its depth, with said depth reaching 16% to 25% of a major axis of the base and said height reaching 110% to 150% of said depth.

14. A golf bag comprising a bag body having an upper portion, a bottom, and a side;

a pair of legs, each leg having a top end with a hinge hole therein and being hinged at said top ends to the upper portion of the bag body;

an actuating lever for selectively moving the legs between retracted and extended positions, said lever having a resilient, flexible lower end, a pair of resilient, flexible upper arms terminating in terminal ends, each terminal end inserted into each of said hinge holes, and a tube covering a major portion of the lever; and a lever holder at the bottom of the bag body to which the lower end of the actuating lever is attached, said lever holder engaging a support surface against which the lever holder is manually set to move the legs from the retracted to the extended position.

15. The golf bag of claim 14 where the base has a cutout section which holds the lower end of the actuating lever, thereby enabling a substantial portion of the lever to be kept in close proximity to the side of the bag body during operation of the lever.

16. The golf hag of claim 15 where said cutout section of the base has a height of larger dimension than its depth, with said depth reaching 16% to 25% of a major axis of the base and said height reaching 110% to 150% of said depth.

17. The golf bag of claim 14 where said upper arms diagonally pass behind the top ends of each legs and being fitted into the hinge holes of the legs from the outside to the inside.

18. The golf bag of claim 14 where the actuating lever is inserted into the bag body through an insert hole in the side of the bag body.

* * * * *